US005506760A

United States Patent [19]

Giebler et al.

[11] Patent Number: 5,506,760

[45] Date of Patent: Apr. 9, 1996

[54] LIGHT FITTING UNIT FOR ILLUMINATED SIGNS

[75] Inventors: Siegfried Giebler, Wüstenrot-Neuhütten; Georg Herok, Heilbronn, both of Germany

[73] Assignee: Temic Telefunken microelectronic GmbH, Heilbronn, Germany

[21] Appl. No.: 249,352

[22] Filed: May 27, 1994

[30] Foreign Application Priority Data

Jul. 1, 1993 [DE] Germany ..... 43 21 823.7

[51] Int. Cl.[6] ..... F21V 21/00

[52] U.S. Cl. ..... 362/249; 362/226; 362/247; 362/800

[58] Field of Search ..... 362/226, 227, 362/237, 240, 241, 247, 249, 252, 269, 800, 235

[56] References Cited

U.S. PATENT DOCUMENTS

| | | | |
|---|---|---|---|
| 2,821,646 | 1/1958 | Walker | 313/108 |
| 3,089,973 | 5/1963 | Herold et al. | 313/108 |
| 3,145,493 | 8/1964 | Escalante | 362/252 |
| 4,019,196 | 4/1977 | Teshima et al. | 357/17 |
| 4,211,955 | 7/1980 | Ray | 362/800 |
| 4,620,268 | 10/1986 | Ferenc | 362/237 |
| 4,783,726 | 11/1988 | Wang | 362/252 |
| 4,812,956 | 3/1989 | Chen | 362/249 |
| 4,907,044 | 3/1990 | Schellhorn et al. | 357/17 |
| 5,160,201 | 11/1992 | Wrobel | 362/249 |
| 5,365,411 | 11/1994 | Rycroft et al. | 362/800 |

FOREIGN PATENT DOCUMENTS

| | | |
|---|---|---|
| 2732780 | 2/1979 | Germany . |
| 3715943 | 12/1988 | Germany . |
| 8909067 U | 1/1990 | Germany . |
| 8911119 U | 3/1990 | Germany . |
| 3833315 | 4/1990 | Germany . |
| 3914448 | 7/1992 | Germany . |
| 4105547 | 8/1992 | Germany . |
| 9302433 U | 5/1993 | Germany . |

*Primary Examiner*—Ira S. Lazarus
*Assistant Examiner*—Alan B. Cariaso
*Attorney, Agent, or Firm*—Spencer & Frank

[57] ABSTRACT

A light fitting unit having a low current input for illuminated signs. The light fitting unit comprises a housing (1) for mounting a plurality of LEDs (4). The housing has four lateral surfaces (1.1–1.4) and two opposite main surfaces (1.5, 1.6). Furthermore, a mounting cap (2) is provided on a first lateral surface (1.1) of the housing. The further lateral surfaces (1.2, 1.3, 1.4) of the housing are enclosed by a groove (3), in the bottom (3.1) of which a plurality of apertures (5) are provided in which a plurality of LEDs (4) are disposed. The light fitting unit can be used as a light source in any illuminated signs instead of conventional bulbs. It is characterized by a low current input and long service life. Fitting in already existing illuminated signs simply by insertion into existing holders is achieved by screw caps or bayonet caps.

9 Claims, 2 Drawing Sheets

FIG. 1
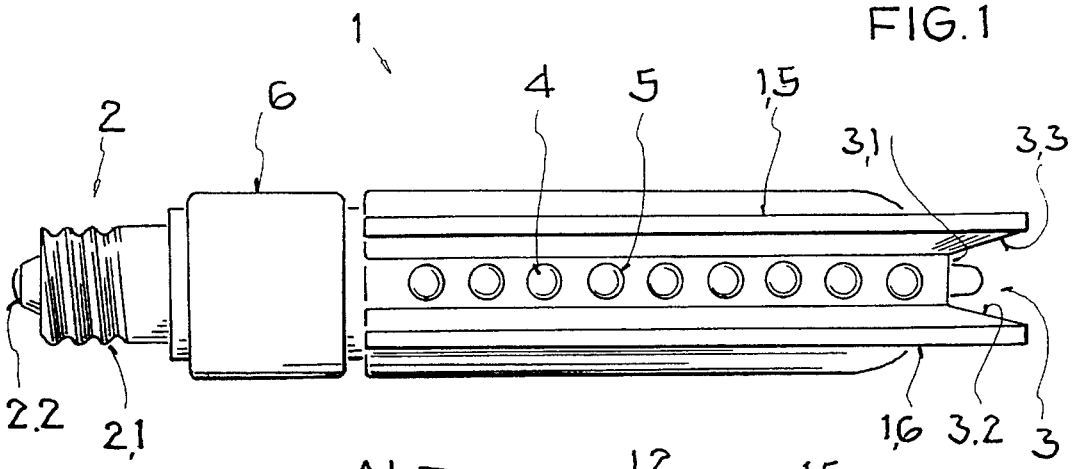
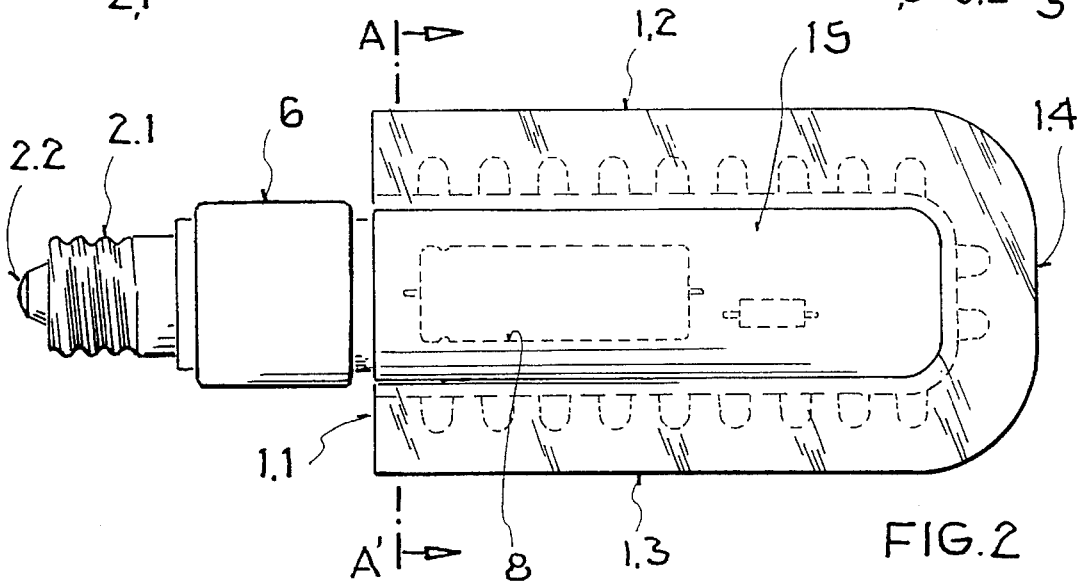
FIG. 2
FIG. 3
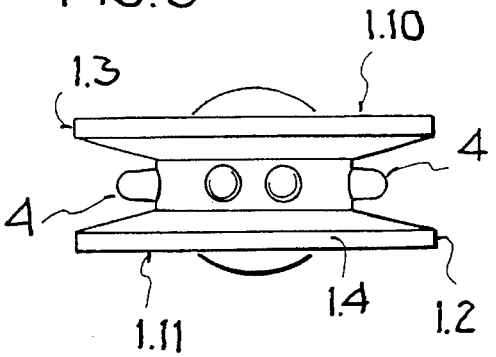
FIG. 4
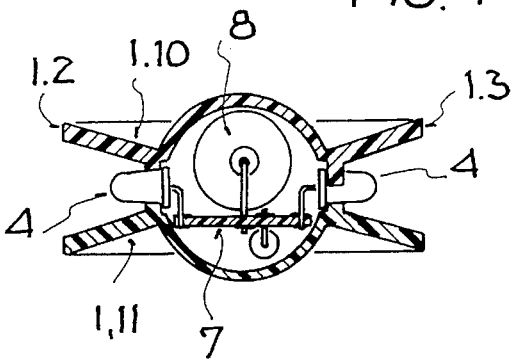

FIG. 5
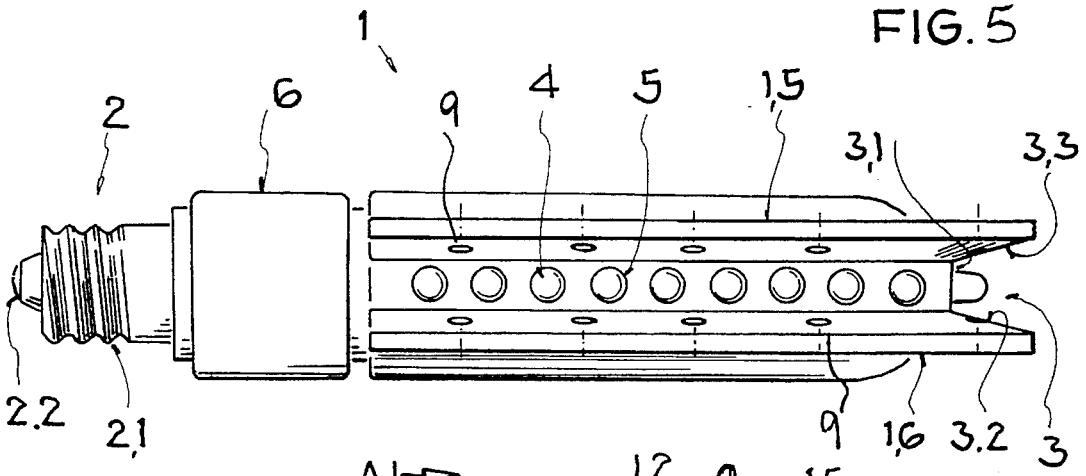
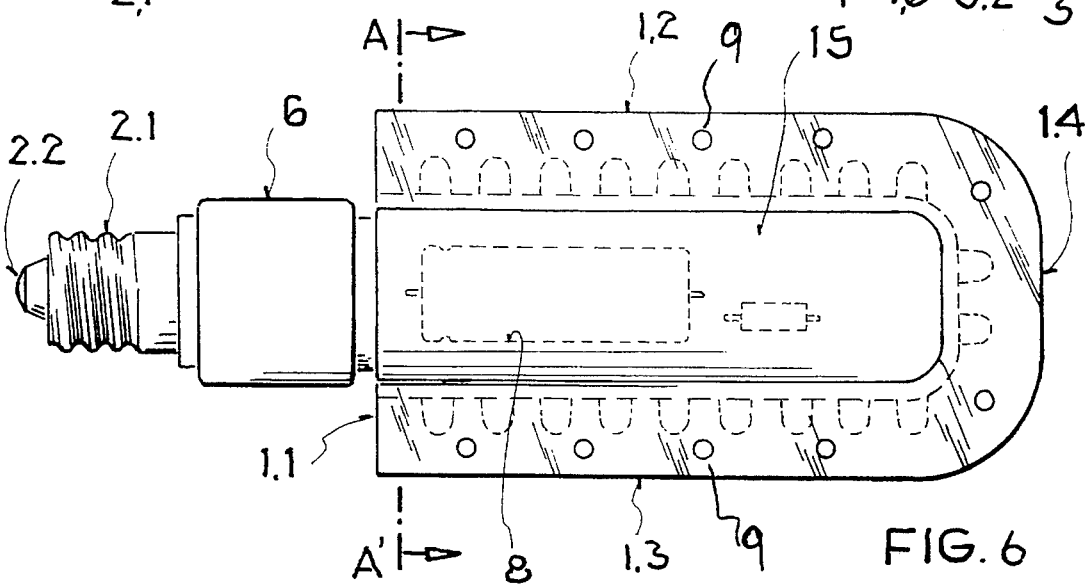
FIG. 6
FIG. 7
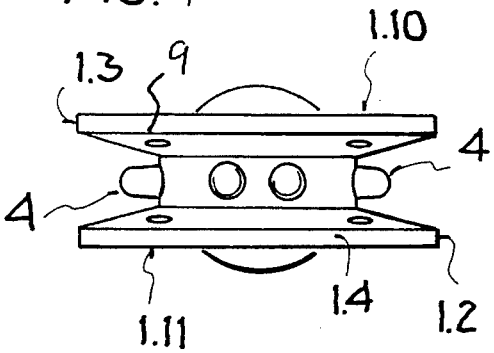
FIG. 8
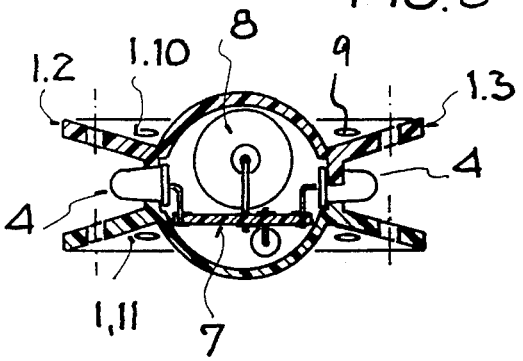

LIGHT FITTING UNIT FOR ILLUMINATED SIGNS

BACKGROUND OF THE INVENTION

The invention relates to a light fitting unit for illuminated signs having a low current input, and a housing for mounting a plurality of light emitting diodes.

Illuminated signs with in the meaning of this patent application are in particular the signs commonly used in the USA to indicate exits. These signs generally comprise a flat, block-shaped housing having two opposite main surfaces. At least one of the two main surfaces has apertures forming the letters to be displayed and other symbols where necessary. In the case in question, the apertures form the word EXIT. The apertures are generally backed with a filter sheet to ensure an even and diffuse light radiation of the illuminated sign.

For illumination, light sources are provided inside the housing. According to the prior art, two or more bulbs are disposed behind the surface provided with apertures. A drawback of the use of bulbs is however that the letters formed by the apertures are only illuminated very unevenly. This unevenness is detrimental to legibility at long distances. To improve the legibility of the sign, bulbs with a high luminous power must be used. This leads to a high power consumption by the illuminated sign. A further drawback is that bulbs have a very limited life, hence impairing the reliability of the illuminated sign.

In the prior art, the substitution of bulbs in the above illuminated signs by light fitting units having a plurality of LEDs is also known. A light fitting unit of this type comprises a rod-like housing body in which a plurality of LEDs are arranged in a line along a lateral surface. These rod-like light fitting units are attached to two opposite lateral surfaces of the housing such that the LEDs radiate mainly parallel to the main surfaces of the illuminated sign. The sign is therefore mainly illuminated by diffusely reflected light. A drawback of these known light fitting units is however that the provision of LEDs on the lateral surfaces means that the letters in the illuminated sign are only illuminated very unevenly, with the brightness decreasing towards the center of the sign. Additional diffusely reflecting parts are therefore necessary for even illumination. A further drawback of these light fitting units is that letters or symbols directly above them are only insufficiently illuminated on account of their lateral attachment. Furthermore, the lateral arrangement has the drawback that bulbs cannot be replaced later on by the known light fitting units.

SUMMARY OF THE INVENTION

The object underlying the invention is therefore to provide a light fitting unit for illuminated signs that can substitute for bulbs in a simple manner, that is characterized by a low current input, and that illuminates the illuminated sign evenly.

This object is attained by a light fitting unit, in particular for illuminated signs, having a housing for mounting a plurality of light emitting diodes wherein the housing has four lateral surfaces and two opposite main surfaces, a mounting cap is provided on a first lateral surface of the housing, and a groove tending over the other three lateral surfaces of the housing is provided, a plurality of apertures are provided in the bottom region of the groove, and a plurality of LEDs are disposed in the apertures. An advantageous embodiment of the invention is the subject of the features in the dependent claims.

The light fitting unit comprises a flat housing for holding a plurality of LEDs. The narrow lateral surfaces have an all-round groove in the bottom of which a plurality of apertures are provided for holding the LEDs. The groove is interrupted at one of the lateral surfaces; a mounting cap is provided on the housing to allow connection of the light fitting unit to the usual sockets for bulbs. The LEDs are advantageously disposed in the groove at regular intervals from one another in order to achieve an even, lateral light radiation.

In accordance with a further embodiment of the invention, the lateral flanks of the groove are inclined to act as reflectors and if possible to deflect all generated light to the side. The inclination angle and the shape of the lateral flanks are matched to the radiation characteristics of the LEDs used. This ensures an optimum light yield and light distribution.

It is advantageous to design the groove so deep that the light radiated by the LEDs leaves the light fitting unit in the main exclusively from the side. As a result, the illuminated sign is evenly illuminated. There are no bright spots due to direct radiation onto the letters.

The mounting cap can, in a further embodiment of the light fitting unit, be rotated independently of the housing using a knurled sleeve. As a result, the light fitting unit can be installed in any arrangement of the housing. The mounting cap can be made in various versions, as a screw cap with different thread sizes for conventional screw holders or as a bayonet socket for appropriate holders. In all cases, electrical contacts are provided in the mounting caps for supplying the light fitting unit with mains voltage.

In an advantageous embodiment of the light fitting unit, a PCB is disposed in the interior of the housing, on which PCB on the one hand the LEDs are mounted and electrically connected and on the other hand a circuit array adjusts the mains voltage to the supply voltage of the LEDs.

BRIEF DESCRIPTION OF THE DRAWINGS

FIGS. 1–3 show a light fitting unit in accordance with the invention from various angles;

FIG. 4 shows a section through the light fitting unit in accordance with the invention along the line A–A' in FIG. 2.

FIGS. 5–8 show a modification of the light fitting unit of FIGS. 1–4 respectively.

DESCRIPTION OF THE PREFERRED EMBODIMENTS

The following describes an embodiment of the invention on the basis of the Figures.

FIGS. 1 to 3 show a preferred embodiment of the invention from various angles. The light fitting unit comprises a housing 1 for holding a plurality of light emitting diodes (LEDs) 4 that generate the light to be radiated. The housing has a lateral all-round groove 3. Apertures 5 are provided in the bottom 3.1 of the groove to hold the plurality of LEDs 4. The lateral flanks 3.2, 3.3 of the groove are slightly inclined and form a reflector for the light generated by the LEDs. The reflector is designed such that all light is reflected laterally. The two main surfaces 1.5, 1.6 of the housing of the light fitting unit are screened off by the groove 3 and its lateral flanks 3.2, 3.3 from the light sources, so that no light is reflected off them. If necessary, however, it is possible to emit light in this area too through apertures 9 in the lateral flanks 3.2, 3.3, and extending perpendicular in the main surface 1.5, 1.6 as shown in FIGS.5–8. The groove 3 is interrupted at a short lateral surface 1.1, where a mounting cap 2 is provided on the housing 1 with which the light fitting unit is fitted inside the illuminated sign. In the embodiment, the mounting cap 2 is designed as a screw cap, as is usual for bulbs. The electrical connection is effected on the one hand via the thread 2.1, and via a centrally located contact 2.2 in exactly the same manner as caps known for bulbs. Instead of a screw cap, various bayonet caps can also be used.

In order to permit fitting of the light fitting unit inside the illuminated sign in various positions with regard to its mounting axis, a knurled sleeve 6 is provided with which the threaded cap or bayonet cap can be rotated regardless of the housing 1. This considerably facilitates both installation and adjustment of the light fitting unit inside the illuminated sign.

In a simplified embodiment, a clamping cap is provided as the mounting cap 2. Electrical connection is then achieved using a connecting lead.

FIG. 4 shows a cross-section through the housing along the line A–A' in FIG. 2. The two housing parts 1.10, 1.11 enclose a printed circuit board (PCB) 7 on which the LEDs 4 are mounted. The PCB also contains a circuit array 8 that transforms the mains voltage into the supply voltage for the LEDs. The LEDs 4 are disposed on the edge of the PCB 7 and radiate the generated light radially. Instead of the standard LEDs shown in the figures, the usual side view LEDs or reflector diodes as described in DE 43 11 530 can also be used to advantage. They are connected to the supply voltage by strip conductors on the PCB 7.

The light fitting unit can be used as the light source in any illuminated signs instead of conventional bulbs. It is characterized by its low current input and long service life. Fitting in already existing illuminated signs simply by insertion into existing holders is achieved by screw caps or bayonet caps. Adjustment of the supply voltage to the mains voltage is achieved by an internal circuit array such that no further measures by the user are necessary. The even arrangement of the LEDs 4 in the groove 3 ensures, together with the reflecting lateral flanks 3.2, 3.3, even lighting of the illuminated sign.

What is claimed is:

1. A light fitting unit, in particular for illuminated signs, having a housing for mounting a plurality of light emitting diodes, wherein said housing has four exterior lateral surfaces and two opposite main surface, wherein a mounting cap is provided on a first of said four lateral surface of said housing, wherein a circumferential groove extending over said further lateral surfaces of said housing is provided, wherein a plurality of apertures are provided in said further lateral surfaces in a bottom of said groove, and, wherein a plurality of light emitting diodes are disposed in said apertures.

2. A light fitting unit according to claim 1, wherein said light emitting diodes are disposed regularly spaced to one another.

3. A light fitting unit according to claim 1, wherein said groove has lateral flanks that are inclined.

4. A light fitting unit according to claim 1, wherein said groove is formed of diffusely reflecting material.

5. A light fitting unit according to claim 4, wherein said groove is sufficiently deep that the light emitting diodes do not project out of said groove, and thereby a major part of the light generated by said LEDs is radiated from said light fitting unit laterally in the plane of said main surfaces.

6. A light fitting unit according to claim 1, wherein said mounting cap is rotatable independently of said housing using a knurled sleeve.

7. A light fitting unit according to claim 6, wherein said mounting cap is a screw cap whose thread forms a first electrical contact and in whose center a second electrical contact is provided.

8. A light fitting unit according to claim 1, wherein said lateral flanks of said groove have small further apertures to achieve an additional light radiation in a direction perpendicular to the main surfaces.

9. A light fitting unit according to claim 1, wherein: said housing comprises two parts forming an interior, a printed circuit board is disposed in aid interior, said light emitting diodes are mounted on said printed circuit board and electrically connected on it, and a circuit array for adjusting the supply voltage of the plurality of said light emitting diodes to a mains voltage is additionally mounted on and electronically connected to said printed circuit board.

* * * * *